United States Patent [19]

Drexhage

[11] Patent Number: 4,613,998

[45] Date of Patent: Sep. 30, 1986

[54] VARIABLE HEIGHT PIVOT CONNECTOR FOR CONVERTIBLE FURNITURE

[76] Inventor: Gerrit K. Drexhage, 910 Centro Way, Mill Valley, Calif. 94941

[21] Appl. No.: 603,488

[22] Filed: Apr. 24, 1984

[51] Int. Cl.[4] ..... A47B 83/00; A47C 19/22

[52] U.S. Cl. ..... 5/136; 5/2 R; 16/246

[58] Field of Search ..... 5/133, 136, 137, 159 R, 5/162, 164, 166, 2 R; 16/245, 246, 238, 382

[56] References Cited

U.S. PATENT DOCUMENTS 3,386,110 6/1968 Vanhentenrijk et al. ..... 297/118
3,537,769 11/1970 Di Carlo ..... 5/2 R
4,318,195 3/1982 Reppas ..... 5/2 R

FOREIGN PATENT DOCUMENTS 1232324 1/1967 Fed. Rep. of Germany ..... 5/2 R

*Primary Examiner*—Alexander Grosz

*Attorney, Agent, or Firm*—T. S. MacDonald; Alan H. MacPherson; Steven F. Caserza

[57] ABSTRACT

A convertible furniture unit includes a tip-up bed (11) whose frame (12) is movable from a horizontal to a vertical position in a wall unit (10) around a torsion bar pivot (20). Connected to the frame (12) is an auxiliary furniture piece (30) such as a table (32) or sofa which is kept horizontal by a parallelogram linkage. As the bed unit (11) is moved from the vertical to horizontal position pivot point (34) attached to the bed frame moves forwardly and downwardly collapsing legs (37,38) with respect to fixed leg (35) and moving legs (37,38) outwardly from its point of connection with pivot connector (50). The table then nests under the bed when the bed is in the "down" position. The pivot connector (50) includes a floor connector (51), a U-shaped post member (57–59) and a hook member (55) which holds the post member on the floor connection. The construction permits adjustment of the table surface (32) above the floor at a particular height when the pivot (34) location is adjusted and permits final levelling of the overall table surface.

8 Claims, 5 Drawing Figures

VARIABLE HEIGHT PIVOT CONNECTOR FOR CONVERTIBLE FURNITURE

CROSS REFERENCE TO RELATED APPLICATION

This invention may utilize the torsion bar assembly shown in my concurrently filed U.S. patent application Ser. No. 603,489 entitled Adjustable Torsion Bar Assembly which application is herein incorporated by reference.

BACKGROUND OF THE INVENTION

1. Field of its Invention

This invention relates to a convertible furniture unit more particularly a bed and auxiliary unit wherein a tip-up bed in the "up" position permits use of an auxiliary furniture piece such as a horizontal table or sofa in the space formerly occupied by the bed and when the bed is in the "down" position is covered by the bed. The auxiliary furniture piece or table during the up and down bed movement remains in a horizontal orientation but during the up and down bed cycle is raised or lowered in a horizontal plane to normal using height or to a collapsed height sufficient to fit under a prone positioned bed. More particularly the present invention is directed to a means for variably adjusting the height of a auxiliary furniture piece such as a table or sofa at various horizontal levels and effecting levelling of the table with respect to the horizontal.

2. Description of the Prior Art

Fixed-in-length foldable legs have been previously used in convertible furniture units as seen in U.S. Pat. No. 3,386,110. A convertible furniture unit is seen in U.S. Pat. No. 4,070,715 in which a desk stays in a horizontal position while a pivoted bed goes from the vertical to horizontal positions with the desk being at a prescribed desk level in the bed vertical position and a lower nested position under the bed in the horizontal position. No means are shown to adjust the desk level in its desk-in-use mode or for otherwise levelling the desk. In commercial versions of Reppas a floor leveling pad has been threaded into a locator bar which bar raises when the pad is adjusted. The desk is guided between its upper and lower positions by a track and roller or geared track with motorized drive. U.S. Pat. No. 4,318,195 illustrates the use of a torsion bar pivot means for a bed/desk convertible unit and pivoted legs to lower a horizontal desk/credenza under a bed as it is lowered and to raise the desk/credenza as the bed is raised to beyond the vertical. While various tables can be provided which have various heights, no adjustment or levelling means is included to change the actual mounting height of the table, as may be required by a customer or as necessary for the particular table design or application provided by the unit manufacturer.

SUMMARY

The present invention provides adjustable table leg mountings for an auxiliary furniture piece such as a table to be lowered and raised to various horizontal levels. It provides for the accurate adjustment of the desired horizontal level and insures perfect levelling of the furniture surface. It thus provides a universal linkage means and pivot connector for allowing tables, for example, to have various use heights as supplied by the manufacturer. The overall invention may be supplied as a table mount/leg/linkage package to the convertible bed manufacturer to be factory-installed for a prescribed table level and a pivot connector package supplied for a user's floor connection and final levelling of the table or other auxiliary unit.

In the preferred embodiment an articulated leg extends from the underside of a table support frame pivoted to the bed frame. The bottom part of such leg is moved outwardly to a horizontal position as the bed frame is pivoted to a horizontal position. The table support frame is mounted in a parallelogram arrangement allowing for lowering and raising of the table. The articulated leg is pivoted at its bottom end to a leg height adjusting pivot connector which is connected to a floor surface in the unit installation area. The pivot connector allows for both relative gross change e.g. from 27" to 29" in table vertical level, with adjustment of the vertical level of the bed frame-to-table support pivot, and for fine-tune horizontal levelling of the entire table surface in the final as-installed position. The latter can compensate for manufacturing tolerances, for variances resultant from the installation of the overall unit in a room recess or separate upright housing for the bed in vertical position, and for variation in the floor level in the installation area.

The invention also permits use when the table is flipped from a horizontal position to a fixed vertical storage position against the raised bed so that upon the bed being lowered the table assumes a position under the bed.

DETAILED DESCRIPTION

Figure 1:
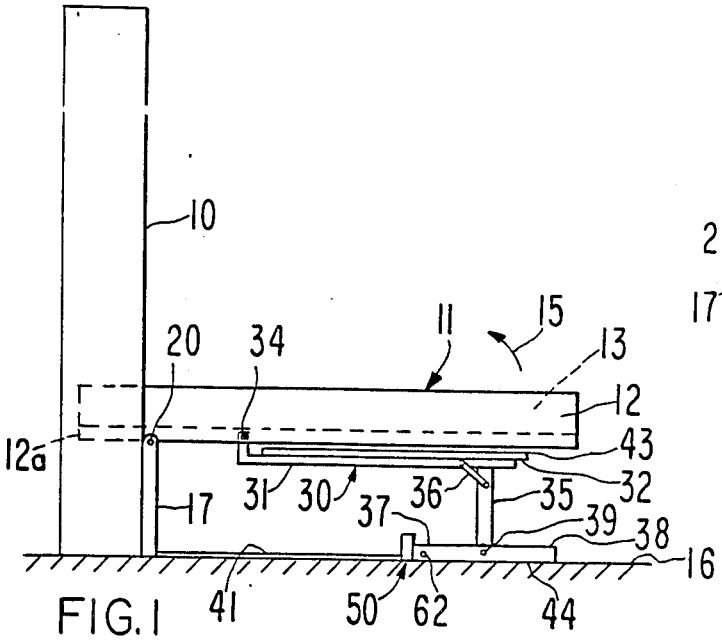
FIG. 1 is a side elevation view of the convertible bed unit in the horizontal prone position with the auxiliary furniture unit stored therebeneath.

FIG. 1 shows a convertible furniture unit which includes a bed unit 11 normally comprising a frame 12, mounting a mattress 13, pivotable on a pivot 20 along arc 15 from the horizontal position shown to a vertical storage position in a storage unit 10 or a room wall recess. Pivot 20 may be a pair of torsion rods held by spaced legs 17 of a torsion frame which torsion rods twist and store energy when the bed is moved from the vertical to horizontal positions. That stored energy is available for assistance in raising the bed back from the horizontal position to the vertical storage position. The details of an adjustable torsion rod pivot assembly is shown in the above recited related patent application. It is mounted to the bed frame 12 or a structural frame (not shown) attached to the interior of frame 12, which structural frame is shown in detail in the related application.

Figure 2:
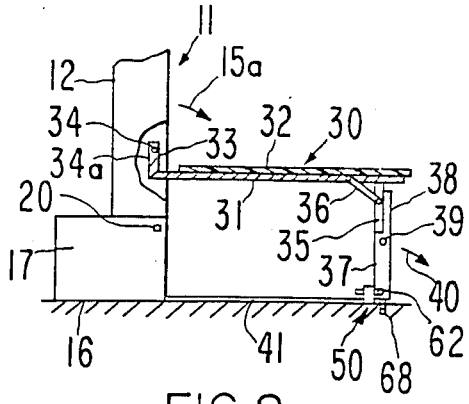
FIG. 2 is a partial cut-away cross-sectional elevation side view of the convertible furniture unit showing the bed unit in vertical storage position and the auxiliary furniture unit in operating mode.

An auxiliary furniture piece 30 including, for example, a table frame 31 is pivotably mounted by leg 33 shown in FIG. 2 and pivot 34 to bed frame 12 dependent on the desired final table height. Mounted on frame 31 is a table surface 32 which in the bed "down" position nests under the bed at a relatively low floor-to-table surface position. The end of the bed may be supported on the top of the table surface or held in spaced position above the table surface by a spacing block member 43 depending from the bed undersurface and abutting the top surface of the table so as to leave a space between the top of the table and the underside of the mattress and its supporting structure. A fixed vertical leg 35 extends downwardly from an outer part of frame 31 and is supported by a fixed strut 36. A bottom articulating leg 37, 38 is pivotably connected by pivot 39 to the bottom of upper leg 35. In the table stored position leg 37, 38 extends parallel to an abutting support surface 16 which normally is a floor in a bedroom, den or other living space. Suitable flat casters 44 are present on the underside of legs 37 and 38 in its horizontal position to bear against a rug or other surface. The lower end portion of leg 37, 38 is pivoted on pivot pin 62 of a variable height pivot connector 50. A locating bar 41 may extend from torsion bar frame spaced legs 17 to the variable pivot connector 50 so as to locate the point on the floor surface 16 at which the table leg support connections should be made but is not necessary for the operation of the device. The upper or outboard portion 38 of the bottom leg of the table support may be of channel construction so that when the leg 37, 38 is vertically extended, portion 38 telescopes around three sides of the lower part of the top leg 35. Portion 38 also covers pivot 39 and results in an aesthetically pleasing straight or tapered overall leg and in the bed supporting mode affords a long stable support for the bed.

FIG. 2 illustrates the mode of operation in which the bed unit 11 including frame 12 has been raised to the vertical position. A parallelogram formed by pivots 34, 39, 62 and 20 and the attached linkages, result in the table 32 of the auxiliary furniture unit 30 being raised from its stored position shown in FIG. 1 to its useful position in FIG. 2. During the various operations shown by arrows 40, 15 and **15*a* in FIGS. 1 and 2 the table stays in a horizontal orientation with respect to floor surface 16 by reason of the described linkage. As pivot point 34 moves inwardly towards the fixed torsion frame assembly including spaced legs 17 and wall unit 10 as the bed frame 12 is raised to the vertical position. At the same time, pivot 34 raises to a higher vertical level directly above the bed pivot 20 in the mode shown in FIG. 2. Vertical leg part 35 is moved upwardly and inwardly towards the torsion frame assembly 17 and lifts the lower leg 37, 38 upwardly until U-shaped lower leg portion 38 telescopes around fixed leg 35. At this point the legs 35 and 37** become one relatively straight load-supporting leg along a vertical linear axis.

Variable height pivot connector 50 (FIG. 4) permits vertical adjustment of the leg 35, 37 in the vertical position so as to level table surface 32 during the installation process. Further, variable height connector 50 permits adjustment of the pivot point 34 for example to position **34*a* at a particular distance from the inward end 12*a* of the bed frame so as to adjust either at the factory or at the time of installation the actual general table height of table surface 32 above floor 16. Pivot connector 50 is mounted into the floor surface 16 by suitable attachment. The U-shaped member or post may be tapped or kicked forward so bight 59 moves on surface 52*a* toward raised portion 52 thus releasing hook 56 from groove 54. The total leg assembly and table 32** can then be moved into any desirable nonhorizontal position. In such mode the table becomes a flip-up table.

Figure 3:
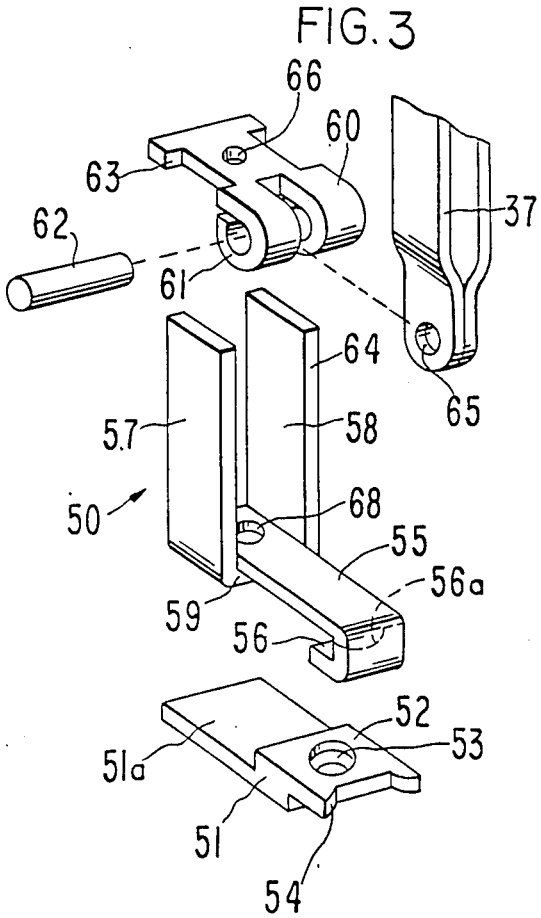
FIG. 3 is an exploded perspective view of the variable height pivot connector for an auxiliary furniture unit.

FIG. 3 shows a detailed exploded view of pivot connector 50. It comprises a floor connection 51 having a stepped lower surface **51*a* and a upper overhanging surface 52. Surface 52 includes a bore 53 and a end slot 54. The floor connector 51 is fixedly connected to a floor surface 16 by a screw 68 the head of which is recessed within bore 53 countersunk for that purpose. The location of the floor connection 51 may be measured by either a rule or accurately located by the use of locator rods 41 shown in the other Figures extending from torsion frame spaced legs 17. A U-shaped post member having upstanding legs 57, 58 and a bight portion 59 is mounted on top surface 51*a*. A hook plate 55 having an aperture 68 is hooked by hook 56 within slot 54 to extend under the raised portion 52 of floor connector 51. The exterior free edge 56*a* of hook 56 may be curved to accomodate screw 68 passing through bore 53. The bight 59 of the U-shape member also contains a vertical bore larger in size and aligned in location to bore 68. A slider means 60 contains opposed grooves 63 which moves vertically along the inside facing edges of legs 57 and 58 and on the outside edges 64 of the U-shaped member. Slider member 60 contains a threaded bore 66. The bottom leg 37 of the table leg assembly contains a horizontal bore 65 which is brought into registration with a horizontal aperture formed by a reentrant end or pintle hinge 61 of the slider means and a pivot pin 62** mounted through the overall apertures.

Figure 4:
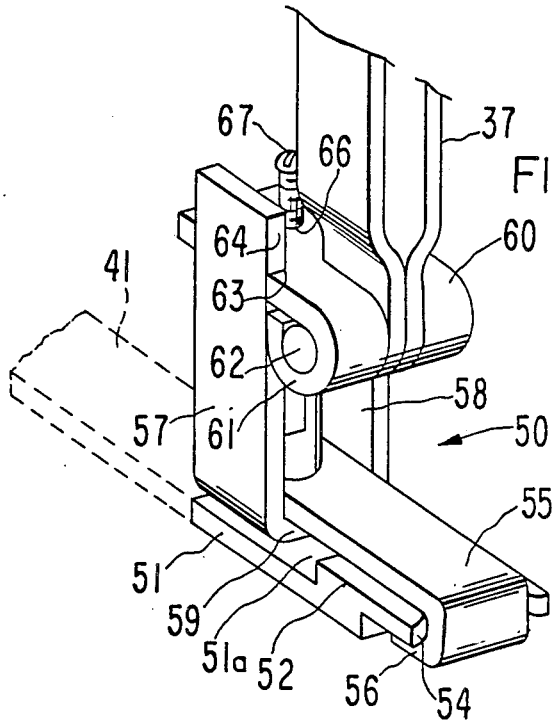
FIG. 4 is a perspective view of an assembled variable height pivot connector for an auxiliary furniture unit

FIG. 4 shows the above described components shown in FIG. 3 of the variable height pivot connector 50 in assembled position. Slider member 60 is shown with its grooves 63 riding on surfaces 64 of the U-shape member and the interior sides of legs 57 and 58. A threaded bolt 67 threadedly extends through threaded bore 66, freely through bore 68 in the hook member and the bight bore. The end of bolt 67 seats or abuts against surface **51*a* or may abut an imperforate bottom 59 of the U-shaped member. In such latter event, the post member and hook plate 55 may be joined as one assembly. Rotation of bolt 67 results in up and down movement of slider member 60 with respect to the floor connection since member 60 can be raised or lowered on the U-shape post as the bolt 67 is turned. Leg 37 is thus adjusted so as to place the supporting table at a particular horizontal level or used for levelling the table upper surface. While only one leg is shown in the Figures it is to be realized that each of the outboard corners of table frame 31 will contain a supporting leg and two pivot connectors 50, two pivots 34 and two legs 33 extending from frame 31 will be employed in each installation. Likewise a pair of locator bars 41** may extend from the torsion bar frame spaced apart the same distance as the legs on the table.

Figure 5:
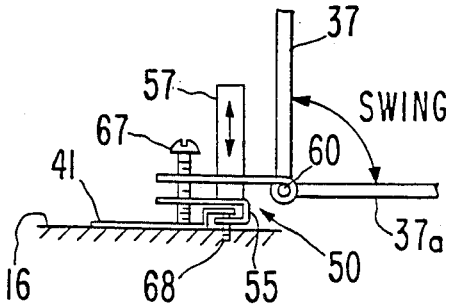
FIG. 5 is a side view of the vertical height pivot connector showing a portion of the leg of the convertible furniture unit in its operating and storage modes.

FIG. 5 is a simplified side view of pivot connector particularly showing the up and down vertical movement of slider member 60 on the post member. Adjustment of bolt 67 moves slider member 60 up and down along the surfaces of the U-shaped post. Lower leg 37 is permitted to swing outwardly to position **37*a* when the bed frame 12 is moved from the vertical position shown in FIG. 2 to the horizontal position shown in FIG. 1. The height of legs 57, 58 (FIG. 3) and the length of ball 67 will approximate from two to three inches in vertical height so as to allow the table to be pre-set at a height above surface 16 from 27 to 29 inches. Further, each of the legs of the table may be individually adjusted by a separate variable height pivot connector 50 so as to level both sides of the table 32**.

The above description of the preferred embodiment of this invention is intended to be illustrative and not limiting. Other embodiments of this invention will be obvious to those skilled in the art in view of the above disclosure.

I claim:

1. A convertible furniture unit comprising:

a tip-up bed including a bed frame pivotable about a pivot mechanism at a frame end between a vertical and a horizontal floor position;

a horizontally-mounted auxiliary furniture piece horizontally positioned with respect to a floor location and pivotably connected to said frame by a linkage for allowing said auxiliary furniture piece to be in a horizontal position with respect to movement of said bed frame in all positions of said bed frame at and between said vertical and horizontal floor positions; and wherein said linkage includes means for adjusting the horizontal level of said auxiliary furniture piece with respect to said floor location;

said means for adjusting comprising:

a floor connector;

a post member extending vertically upwardly from said connector;

a pivotable leg connected to and extending downwardly from said horizontally-mounted auxiliary furniture piece; and slider means pivotably connected to said leg and slidable vertically on said post member to adjust the position of said leg with respect to said connector.

2. The unit of claim 1 in which said leg is hinged intermediate of said slider means pivot connection and an attachment point of said leg with said auxiliary furniture piece.

3. The unit of claim 1 in which said leg comprises:

a top downwardly extending portion fixed to said attachment point of said leg and a pivotable bottom portion pivotably fixed to said leg top portion and pivotably connected to said slider means; and whereby said top and bottom leg portions are in alignment when said tip-up bed is in the vertical position and are at a 90° position with respect to each other when said tip-up bed is in the horizontal position

4. The unit of claim 3 in which said leg bottom portion includes a fixed U-shaped upper hollow extension which in the vertical position abuts said leg upper portion and in a horizontal position extends outwardly with respect to said frame end from a pivot between said top and bottom leg portions and wherein said leg bottom portion extends inwardly toward said frame end to said floor connector.

5. The unit of claim 1 wherein said post member comprises a U-shaped channel containing a bolt aperture in the bight thereof; and including means including a second aperture alignable with said bolt aperture for connecting said channel to said floor connector;

said slider member including spaced groove means slidable on vertical edges of said channel;

pivot pin means connecting said slider member to said leg bottom portion; and a screw bolt threadedly extending through said slider member, freely through said channel aperture and said second aperture and abutting said floor connector to raise and lower said slider member and leg with respect to said floor connector.

6. A pivot connector to variably adjust the vertical height of an attached member with respect to a fixed surface, said connector comprising:

a connector plate attachable to a fixed surface;

a U-shaped channel member having vertically upright legs, said channel member being attachable to said connector plate;

a slider member slidably connected to said legs and containing a reentrant end, said attached member having an apertured end alignable with said reentrant end, a pivot connecting said apertured end to said reentrant end and a threaded bore opposite said reentrant end; and an adjustment bolt extending in threaded engagement with said bore and engageable with said connector plate to adjust the height of said slider member and attached member.

7. The pivot connector of claim 6 including a hooked clamping bar connecting said channel member to said connector plate.

8. The pivot connector of claim 6 in which said slider member includes spaced groove means slidable on said channel legs; and pivot pin means connecting said slider member to said attached member.

* * * * *